United States Patent [19]

Schroeder

[11] Patent Number: 4,916,910

[45] Date of Patent: Apr. 17, 1990

[54] LOW PROFILE DRINK DISPENSER

[75] Inventor: Alfred A. Schroeder, San Antonio, Tex.

[73] Assignee: Lancer Corporation, San Antonio, Tex.

[21] Appl. No.: 217,169

[22] Filed: Jul. 11, 1988

[51] Int. Cl.[4] ..... F25D 3/00

[52] U.S. Cl. ..... 62/59; 62/390; 62/434

[58] Field of Search ..... 62/59, 77, 390, 434

[56] References Cited

U.S. PATENT DOCUMENTS 2,170,993 8/1939 Grady ..... 62/59

3,892,335 7/1975 Schroeder ..... 62/390

*Primary Examiner*—Ronald C. Capossela

*Attorney, Agent, or Firm*—Cox & Smith Incorporated

[57] ABSTRACT

A beverage dispenser of the post mix type having evaporator coils configured in a particular manner to form a slab of ice within a cooling chamber, the formation of which slab of ice is controlled by a thermostat so that a vertically oriented passage is formed in the center of the slab to allow the rotation of an impeller shaft. With the cooling chamber and a passage for connecting with dispenser valves being insulated beneath and beside the compressor and other heat generating components of the cooling unit, the impeller is thus able to operate beneath the ice slab to circulate cooled water around beverage conduits that are layered in a compact configuration, the overall arrangement of the beverage dispenser being compact and resulting in a easily serviceable beverage dispenser having a low profile while also providing a relatively large ice bank and enabling optimum heat exchange between the beverage conduits and the slab of ice without causing freezing of the beverages.

8 Claims, 3 Drawing Sheets

LOW PROFILE DRINK DISPENSER

BACKGROUND AND SUMMARY

This invention relates to a device for dispensing beverages, and more particularly, to improvements on such a device for reducing the space occupied thereby and for ensuring adequate cooling of the dispensed beverages while also maintaining a large drink serving capacity.

In typical locations where beverages are dispensed, such as in cafeterias and snack bars, the value of counterspace is at a premium. Counterspace in a food serving line is very expensive, especially in larger metropolitan areas. For this reason, beverage dispensing machines are desirably small and compact.

The width of a counter top beverage dispensing machine is usually determined by the number of different beverages to be dispensed since the sizes of a glass and of the hand which holds it are more or less constant. The size of individual dispensing nozzels are thus engineered based on those constants. The depth of such a machine is not as critical but is usually constrained by the depth of the counter on which the machine is positioned—typically 24 inches. The height of a dispensing machine, however, usually extends well above the top of the beverage dispensing nozzels. A machine having a lower height dimension, or "profile," not only enables placement of more items above or below the machine, but also enables greater contact between customers and servers who are on opposite sides of the machine.

Another primary concern related to beverage dispensing apparatus is the ease with which the apparatus may be serviced. The cooling unit of a dispenser is usually the part that needs repair, and since commercial establishments which serve beverages depend upon their beverage dispenser for consumer satisfaction, it is critical that the unit can be easily serviced and repaired without significant interruption of the dispenser's use. Because of this, the most ideal method for repairing a dispenser is to remove the malfunctioning cooling unit and replace it immediately with another unit. The defective unit can then be taken to a shop for repairs.

It is also critical for a beverage dispenser to adequately cool dispensed beverages despite frequent use of the dispenser over extended periods of time. One of the most successful methods for accomplishing this objective is to provide a machine which, during periods of non-use, forms an ice bank which slowly melts while cooling the beverages during periods of frequent use. To provide a heat pumping unit which could adequately cool beverages without such an ice bank would put unfeasible power requirements on the unit; the necessary unit would be expensive and over-sized.

Typically, the evaporator coils are part of an electric refrigeration system and the cooling liquid is water which fills a tank in which the ice bank forms. The beverage lines in such a unit, which beverage lines are also submerged within the tank in order to enable cooling, are configured relative to the ice bank in one of several common arrangements. The water is cooled by ice forming on the evaporator coils and the cooled water is circulated about the beverage lines by an impeller or other circulating means in order to cool the beverages to a desired temperature. Such a beverage dispenser is disclosed in the inventor's U.S. Pat. No. 3,892,335, entitled "Beverage Dispenser" which issued July 1, 1975, and the present invention incorporates several of the features disclosed by that patent.

The ability of such beverage dispensers to adequately cool during extended periods of frequent use depends significantly upon the size and orientation of the ice bank relative to the beverage lines. In fact, since larger ice banks ordinarily take longer amounts of time to melt, the volume of the ice bank formed in such a dispenser is a primary consideration for rating the dispenser. Those factors combined with the degree of insulation provided, the effectiveness of the cooling unit and the manner of circulation within the cooling tank usually determine the dispenser's ability to adequately operate. To optimize each of those factors while minimizing space is the primary challenge in the technology of beverage dispensers.

Beverage dispensers of this type are also rated by the number of drinks that can be dispensed below a given temperature during a given period of time, and by the temperature of the "occasional drink" (i.e., the temperature of a drink dispensed after the dispenser has not been used for a period of several hours). In the beverage dispensing market, it is desirable that the beverages be dispensed at a temperature of 40° F. or below. A test generally used to determine the maximum capacity of a beverage dispensing apparatus is one determining the total number of 12 oz. beverages that a machine can dispense in a given period of time without exceeding the maximum temperature of 40° F. The occasional drink, which may contain some beverage from lines between the cooling tank and the nozzle, should be maintained below the desired temperature as well.

Two basic arrangements between the evaporator coils and the beverage lines are common in the art. Many models have the beverage lines running around the inside periphery of the tank, starting and terminating at some point exterior to the tank, with the evaporator coil submerged inside the beverage lines. Although this type of design is relatively compact, it suffers a major downfall in that there is relatively little space in which ice can form around the evaporator coils and, in the event of irregular or excessive ice formation, the beverage lines may become frozen within the ice bank. If such occurs, the cooling unit cannot be easily removed without first thawing the ice.

Another arrangement known in the art reverses the previously discussed arrangement so that the evaporator coils are positioned circumferentially around the beverage lines. This second arrangement has the benefit of larger spaces for formation of an ice bank around the evaporator coils but still may present the problem of freezing the beverage lines within the ice bank. Furthermore, with this second arrangement where beverage lines run under the evaporator coils and up the side of the tank in order to enter or exit the tank (as is common in the art) such beverage lines and the beverage contained therein would also be subject to freezing, particularly if not in continual use.

Therefore, it is a primary object of the present invention to provide a beverage dispensing apparatus that alleviates the problems encountered by the prior art and that has a low profile as well as the capacity to form a relatively large ice bank which effectively cools beverage lines. Other objects will be obvious to one of ordinary skill in the art from the foregoing and the following descriptions and discussions, particularly when considered in light of the attached drawings and appended claims.

SUMMARY

The present invention addresses the aforesaid objects and others by providing an apparatus and method for refrigerating beverages in a beverage dispenser which includes means for forming in a cooling chamber a slab-like ice bank above beverage conduits which conduct the beverages to be dispensed into the cooling chamber from within an insulated space and from in front of a baffle plate.

The ice bank is formed in the cooling chamber, which is a subchamber defined by the baffle plate within a larger insulated receptacle, around evaporator coils which are closely stacked in the verticle direction but roughly uniformly spaced between the walls of the cooling chamber. The evaporator coils are positioned in a configuration which forms an ice bank that encapsulates the cooling chamber by spanning between its walls but that allows for passage of an impeller shaft therethrough. Thus, the heat generating components of the cooling unit are positioned above the cooling chamber which is insulated therefrom, and an impeller is able to be operated in the cooling chamber at its optimum position for circulating water between the ice bank slab and the beverage conduits as a heat exchange medium therebetween. The water also provides a ready source for formation of the ice bank around the evaporator coils.

The beverage conduits themselves are connected to external liquid supplies for supplying the nozzles of the beverage dispenser, and substantial lengths of the beverage conduits are configured in a compact, layered fashion beneath the slab of the ice bank which enables optimum cooling of the beverages flowing therethrough. Thus the dispenser has a low profile and cools the beverages by using the method of first forming a slab of ice which spans between the perimeters of the cooling chamber at the upper portions thereof, and then directing the beverages through beverage conduits contained in the lower portions of the cooling chamber.

Many other features, advantages and modifications within the scope of this invention will be obvious to one of ordinary skill in the art in light of the foregoing and the following.

DETAILED DESCRIPTION OF THE PREFERRED EMBODIMENT

Figure 1:
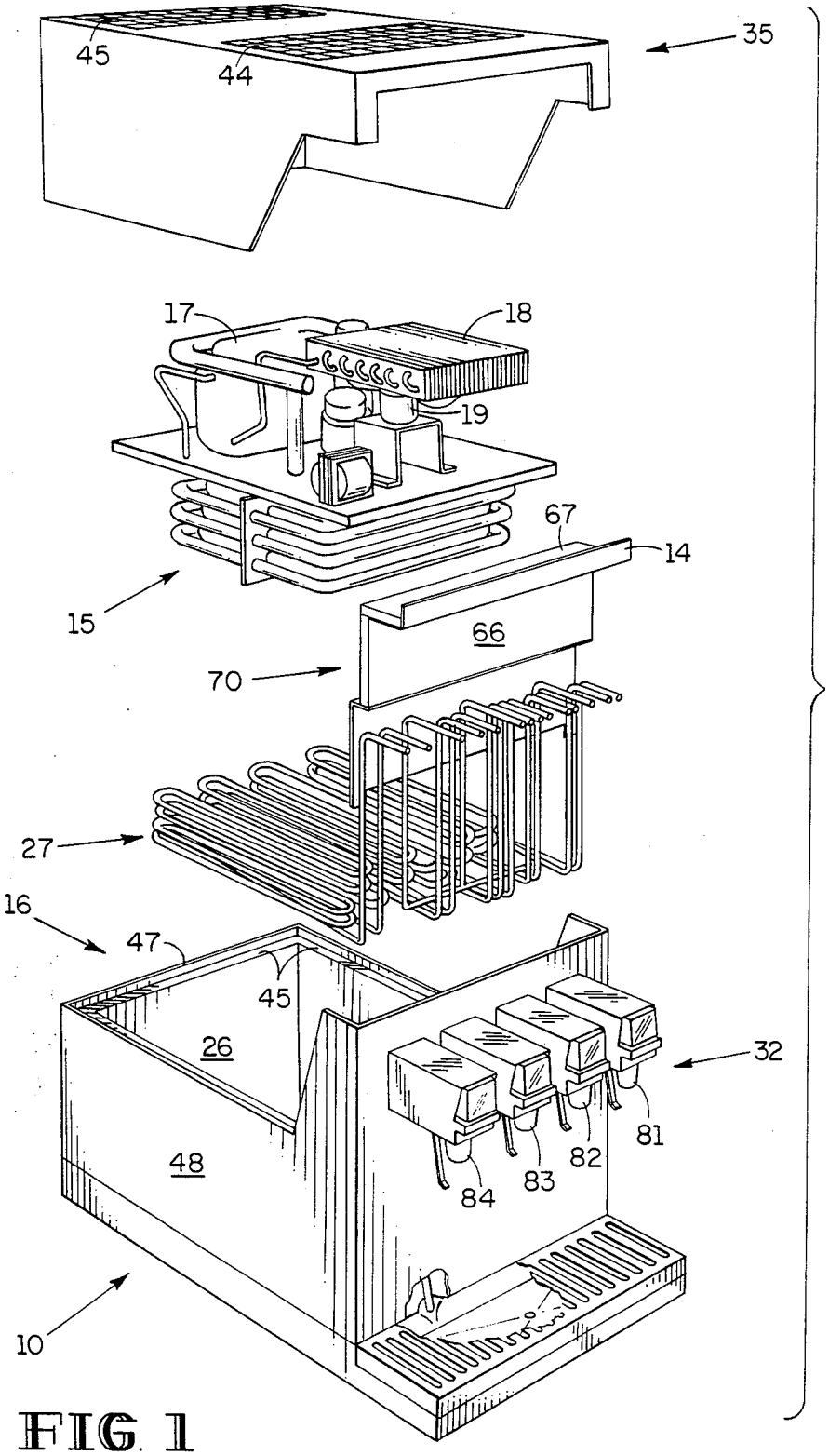
FIG. 1 shows the preferred embodiment in an exploded, bird's-eye perspective view which distinguishes cover 35, cooling unit 15, divider 70, beverage lines 27 and tank portion 16.
Figure 2:
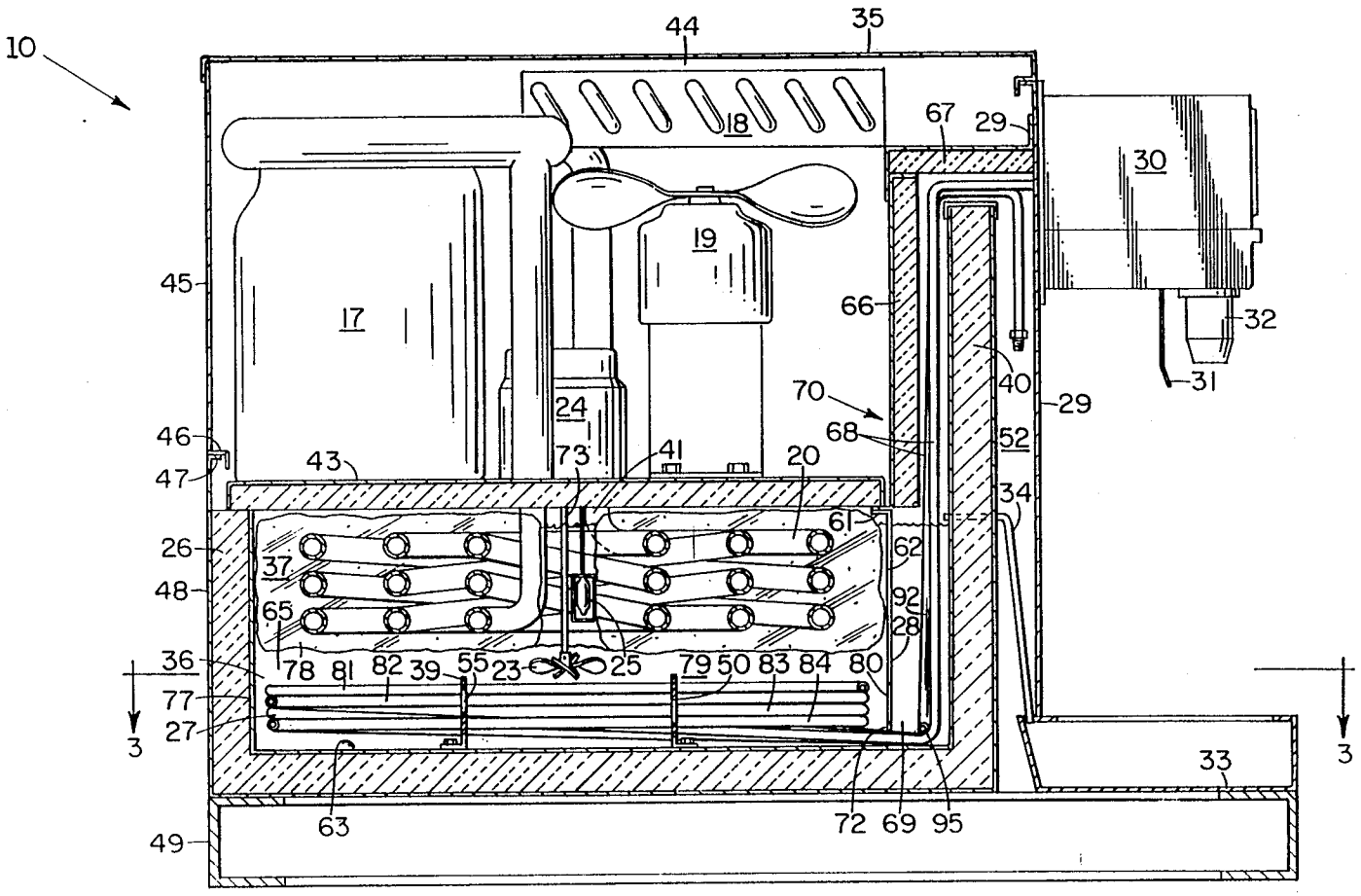
FIG. 2 shows a central cross-sectional view of the preferred embodiment of FIG. 1 as viewed from the right side.

Beverage dispenser 10 having a low profile is shown generally in FIG. 1 in an exploded view. Beverage dispenser 10 is also shown in a cross-sectioned elevation view in FIG. 2. Referring to FIG. 2, beverage dispenser 10 generally operates to refrigerate beverages flowing through beverage conduits 27. During period of minimal usage of beverage dispenser 10, an ice bank 37 forms around evaporator coils 20. This ice bank 37 refrigerates water 36 contained within insulated tank 26 and circulates water 36 about beverage conduits 27 by the operation of impeller 23. Conduits 27 are, thus, refrigerated and beverages communicating therethrough are also refrigerated before being dispensed through nozzles 32.

Referring to FIG. 1, beverage dispenser 10 has a cover 35 positioned over condensor-evaporator 15 for protecting and decorating beverage dispenser 10. Cover 35 generally encloses condensor-evaporator 15 while also enabling free communication of air to condensor-evaporator 15. Cooling unit 15 basically has standard components which operate in a standard fashion. Cover 35 is composed substantially of a thin, elastic material (such as a metal) and mounts atop tank portion 16 by means of gravity and fitting adaptations 46 (shown in FIG. 2) formed in the lower edges of cover 35. The fitting adaptations 46 formed in cover 35 are set on flange 47, or other suitable adaptations, formed from the upper edge of casing 48 which encases insulated receptacle 26.

Condensor-evaporator 15 has a compressor 17 that pressurizes a gaseous refrigerant such as freon to an extreme pressure. The refrigerant is then changed to a liquid phase in condenser 18 as heat is removed therefrom. Condenser 18 is cooled by means of fan 19 which draws air through vent 44 for blowing through condenser 18 and vent 45. The liquid refrigerant is then drawn through line 41 (shown in FIG. 2) into evaporator coils 20 by lower pressure therein, and evaporation of the refrigerant within evaporator coils 20 draws heat from the sPace surrounding evaporator coils 20. Ice bank 37 is therefore formed from water 36 around evaporator coils 20. Once fully circulated through the course of evaporator coils 20, the refrigerant (fully transformed back to its phase state) is drawn by compressor 17 upwardly through line 42 and into compressor 17 where the just described refrigeration cycle begins again.

Referring to FIG. 2, cooling unit 15 basically comprises compressor 17, motor 24, fan 19, condenser 18 and evaporator coils 20, each of those components being operatively mounted on platform 43 and operatively connected between each other. Platform 43 is preferably insulated. The great amount of heat removed from condensers 18 through convection enabled by fan 19 is dissipated upwardly, away from cooling chamber 65 and through vent 45 in cover 35. This heat dissipation is facilitated by the natural tendency of heated air to rise, and the air displaced through vent 45 is replaced with air entering through rear vent 44 in cover 35. The platform 43 rests on the upper portions of insulating receptacle 26, and platform 43 is secured to tank portion 16 by means of bolts (not shown). The front edge of platform 43 rests on flange 61.

The condensor evaporator 15 is removed from its mount on tank portion 16 simply by removing the bolts which secure it and then manually lifting cooling unit 15 above and away from tank portion 16. Ice bank 37 is removed from tank portion 16 along with condensor-evaporator 15 despite minimal clearance between the perimeter of ice bank 37 and inner surfaces of tank portion 16. Removal of ice bank 37 from tank portion 16 is enabled by the shape and position of baffle plate 28 relative to flange 61; particularly, the upper portion 62 of baffle plate 28 is slightly slanted from the vertical in order to restrict the size of the lower portions of ice bank 37. Also the distal edge of flange 61 is approximately flush with the slanted upper portion 62 of baffle plate 28. The lower portion 80 of baffle plate 28 is bent relative to upper portion 62 and is approximately vertical. Tabs 81 (shown in FIG. 3) which extend from and are bent relative to the power portion 80 of baffle plate 28, are fixed by common means such as a weld to the lower surface 63 of insulated receptacle 26. Thus, cooling unit 15 can be easily removed and replaced in the event that cooling unit 15 malfunctions.

Base 49, dispenser heads 30, drain pan 33 and insulated receptacle 26 are each rigidly connected to one another to form a composite structure referred to as "tank portion 16." Insulated receptacle 26 is encased in casing 48. Beverage conduits 27 are arranged, for the most part, in the lowermost portions of insulated receptacle 26 and are held in place by brackets 39 and 50. Brackets 39 and 50, which are rigidly connected to the lower surface 63 of insulated receptacle 26, are adapted with appropriate holes for receiving beverage conduits 27 therethrough and also have staggered holes 51, 64 for enabling free flow of water 36 through brackets 39 and 50.

Once beverage conduits 27 are secured in place during assembly, divider 70 is secured in its operative position in order to fully insulate the exiting and entering portions 68 of beverage conduits 27. Divider 70 includes baffle plate 28 and insulated panels 66, 67. Divider 70 engages and may be attached to front wall 29 at flange 14, which flange 14 is integral with insulated panel 67. Insulated panels 66, 67 insulate the portions 68 of beverage conduits 27 from heat generated by cooling unit 15. Insulated panels 66 and 67 along with the upper portion of insulated wall 40, thus, help to maintain the desired temperature of the "occasional drink." Flange 61 is integral with insulated panel 66. Baffle plate 28 is rigidly connected by a weld to flange 61 and is a part of divider 70. As previously mentioned baffle plate 28 serves to limit the size of ice bank 37, and baffle plate 28 also serves to define a cooling chamber 65 within insulated receptacle 26.

Cooling chamber 65 is defined by baffle plate 28, the rear and side walls of insulated receptacle 26, platform 43, and the lower surface 63 of insulated receptacle 26. Baffle plate 28, the rear wall 100 (numbered in FIG. 3) and appropriate portions of the side walls of 101, 102 insulated receptacle 26 are, therefore, the walls of cooling chamber 65. Baffle plate 28 limits communication of water 36 between cooling chamber 65 and chamber 69 (referred to as "portal chamber 69"). Despite the limited communication of water post baffle plate 28, the temperature of water 36 in portal chamber 69 approximates the temperature of water 36 in cooling chamber 65 due to conduction of heat through baffle plate 28 and circulation beneath and around baffle plate 28. Nevertheless, most of the heat is drawn from beverage conduits 27 within cooling chamber 65 since substantial lengths of beverage conduits 27 are contained therein. The insulated passageway (defined by insulated wall 40 and panels 66, 67) through which portions 28 pass is in free communication with portal chamber 69. That insulated passageway together with portal chamber 69 is referred to as the "insulated passage" which is provided for insulating the portions of beverage conduits 27 which run between cooling chamber 65 and dispenser heads 30.

Beverage conduits 27 are connected in fluid communication with various liquid supplies (not shown) for supplying soda, syrups and water to dispenser heads 30. To enter cooling chamber 65, the beverage conduits 27 pass through dead space 52, over the top of insulating wall 40, through the insulated space between insulating wall 40 and insulated panels 66 and 67, and through the horizontal gap beneath baffle plate 28. Each of the beverage conduits 27 are connected directly to dispenser heads 30 in a manner which appropriately supplies their liquids to desired ones of nozzels 32. Beverage dispenser 10 is of the post-mix type, where syrup and soda may be mixed together inside each of the nozzles 32 of dispenser heads 30. Of course, it could be of the premix type as well. An independent line for providing a single liquid, such as water, to one of the nozzles 32 is also provided. Each of the liquids supplied by beverage conduits 27 to nozzles 32 are desired to be cooled before being dispensed. Such cooling is accomplished by circulating the respective liquids through beverage conduits 27 within cooling chamber 65 in a manner such that certain ones of beverage conduits 27 have greater lengths of conduit within cooling chamber 65 than do other ones of beverage conduits 27. The liquids which are anticipated to be of greater demand are conducted through the certain ones of beverage conduits 27 which have greater lengths and cooling chamber 65 in order to ensure adequate cooling of that liquid despite its greater demand.

Figure 3:
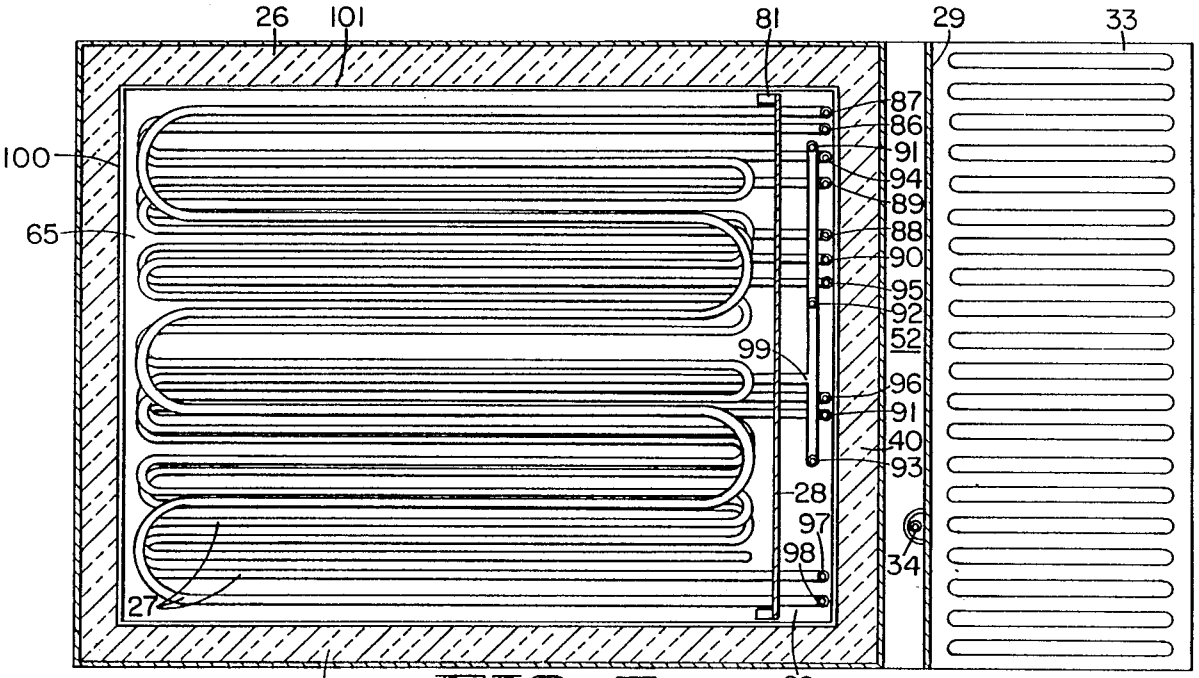
FIG. 3 is a cross-sectional view of the tank portion 16, divider 70, and beverage lines 27 of FIG. 1 as viewed on plane 3—3 shown in FIG. 2.

Referring to FIG. 3 and to individual nozzels 81-84 (shown in FIG. 1) of nozzles 32, beverage conduits 27 are connected with liquid entering insulated receptacle 26 through individual lines 86-91. Those lines 86-91 are in appropriate communication with individual lines 92-98 which direct the various liquids to exit insulated receptacle 26 therethrough for subsequent dispensation through certain ones of nozzles 32. Accordingly, individual lines 86–91 are referred to as input lines 86–91, and individual lines 92–98 are referred to output lines 92–98. Each of input lines 86–91 are appropriately connected to liquid supplies external to beverage dispenser 10 and each output lines 92–98 conduct cooled liquid directly to individual ones of nozzles 32.

Input line 86 conducts soda into cooling chamber 65, and input line 86 conducts the soda through coupling 99 to each one of output lines 91–93. Each of input lines 88–91 are ideally connected to respectively different syrup supplies A, B, C and D, respectively, for suppling those syrups A–D to output lines 94–97, respectively. Each of the individual beverage conduits which conduct syrups A–D are referred to as "syrup lines" followed by a designation for the particular one of syrups A–D which it carries; for instance, the syrup line between input line 88 and output line 94 is referred to as syrup line A. Each of syrup lines A–D are connected to supply syrups A–D, respectively, (or other liquids as desired) to nozzles 81–84, respectively. Each of syrup lines A–D include certain lengths of beverage conduit within cooling chamber 65, which certain lengths are each equivalent to the certain lengths of the others of syrup lines A–D. For a different perspective of the same configuration, the output lines 92 and 95 are visible in the central cross-sectional view of FIG. 2.

Referring again to FIG. 3, input line 87 is ideally connected to a water supply containing water for non-carbonated drinks, and output lines 98 is connected in fluid communication with input 87 for supplying drinking water, or other desirable liquid, to nozzle 84. Thus, the beverage hook-ups enabled by lines 86–98 ideally supply mixed syrups and soda to nozzles 81–83 while also supplying plain water to nozzle 84. Alternatively, though, if a syrup and soda mixture is desired to be dispensed from nozzle 84, input line 87 is connected to a soda supply and syrup line D is operatively connected for supplying nozzle 84 with a soda and syrup mixture. Output lines 91–93, containing the same liquid which is ideally soda are operatively connected to supply that liquid to nozzles 81–83 respectively. The beverage conduit between input line 87 and output 98 is referred to as a "water line" and the portion of beverage conduit between input line 86 and coupling 99 is referred to as a "soda line."

Referring to FIG. 2, the beverage conduits 27 are configured within cooling chamber 65 in four horizontally oriented layers 81-84 in a compact fashion. Layer 81 contains only the water line. The soda line, which is approximately four times the length of any individual one of syrup lines A–D, is contained in substantial part on layer 82 and part of layer 83. Syrup line B and half of syrup line A are contained in substantial part on layer 83, and syrup lines C and D and half of syrup line A are contained in substantial part on 84. Each of the respective beverage conduit 27 are directed into and out of cooling chamber 65 by slanted portions thereof which direct them to their appropriate one of layers 81–84; for instance, syrup line B can be seen in FIG. 2 as slanting from output line 85 to layer 83 Similar slanted portions enable both of syrup line A and the soda line to be configured on multiple layers of layers 81–84.

The portions of the beverage conduits 27 contained on the individual layers 81–84 are configured in accordian-like manner on those layers for maximizing the heat transfer between beverage conduits 27 and water 36 while also configuring beverage conduits 27 in a compact space. The accordian-like configeration is visible in FIG. 3 as well. This configuration optimizes the heat exchange between beverage conduits 27 and ice bank 37 while minimizing the profile contributed to by beverage conduits 27. Each of the layers 81–84 are a horizontal plane containing flat configurations of portions of beverage conduits 27.

To operate, beverage is dispensed out of one of nozzles 32 by pushing the respective lever 31. A number of dispenser heads 30 and beverage conduits 27 will allow for a variety of drinks. Drain pan 33 catch of any spillage that may occur while dispensing the desired beverage. Overflow line 34 emPties any overflow water from within insulating receptacle 26 into drain Pan 33.

The evaporator coils 20 are immersed in the water 36 so that, after running the cooling unit 15 a period of time, ice bank 37 will form about the evaporator coils 20.

Evaporator coils 20 are a single, continuous coolant conduit running from line 41 to line 42. The configuration of evaporator coil 20, as is obvious from FIGS. 1 and 2 has closely stacked horizontal layers, each layer containing roughly three approximately square shaped sections of evaporator coils 20. In each of the horizontal layers of evaporator coils 20, the coils are approximately evenly spaced between the walls 100–102 and baffle plate 28, although slight extra space is provided in the center of cooling chamber 65 to allow for rotation of shaft 73. Impeller 23, operatively connected by shaft 73 to motor 24 for rotating impeller 23, circulates the water inside the insulated reservoir 26. An ice bank control 25 that controls the compressor 17 is positioned within insulating receptacle 26. Ice bank control 25 limits the size of the ice bank. During regular formation of ice bank 37, ice bank 37 becomes progressively larger Operation of ice bank control 25, therefore, regulates the formation of ice bank 37 so that it does not exceed the desired size and shape. Ice bank control 25, along with the natural thawing action of the water 36 being circulated beneath ice bank 37, also regulates the formation of ice bank 37 in a manner such that beverage conduits 27 do not become frozen within ice bank 37.

Ice bank 37, thus forms into a thick slab of ice which encapsulates cooling chamber 65 except for at a central passage through ice bank 37, which central passage has a vertical axis and is formed to allow movement of shaft 73. The perimeters of ice bank 37 engage the rear wall 77, baffle plate 28 and the two side walls of insulated receptacle 26, and ice bank 37 spans the space therebetween. Such an ice bank as ice bank 37 maximizes the size of the ice bank 37 while minimizing its height, or "profile."

The beverage conduits 27 are positioned beneath the ice bank 37 within cooling chamber 65, with impeller 23 being located near the center of cooling chamber 65. Impeller 23 rotates in the space 79 which is between lower surface 78 and the upper one of beverage conduits 27. In the alternative embodiments (not shown), however, impeller 23 rotates in the midst of the beverage conduits 27 or within the ice bank. In that embodiment, the configuration of beverage conduits 27 is modified in a manner which provides a space for the rotation of impeller 23 in the midst of beverage lines 27 so that the profile of the dispenser can be even further minimized as ice bank 37 forms closer to beverage lines 27. Referring again to the preferred embodiment of FIG. 2, impeller 23 circulates water 36 to obtain a uniform heat distribution beneath ice bank 37.

Beverage conduits 27, configured and held in place in a compact configuration beneath ice bank 37 as previously discussed, are cooled by water 36 which is circulated by impeller 23. The water 36 is propelled downwardly in the central portion of cooling chamber 65, and then flows radially outwardly from the center due to stagnation of the flow with the lower surface 63. Consequently, impeller 23 forces water 36 to flow in a circulatory manner, water 36 flowing upwardly in the outer areas adjacent beverage lines 27 and then being drawn across the lower surface 78 of ice bank 37 where water 36 is cooled until it is again propelled downwardly by impeller 23. Lower surface 78 is approximately planar. Because of the small amount of liquid water 36 within cooling chamber 65 relative to the size of ice bank 37, the circulatory flow created by impeller 23 optimumly cools beverage conduits 27 and maintains an approximately uniform temperature in cooling chamber 65.

Brackets 39 and 50, which are connected to the lower surface 63 of insulating receptacle 26 by suitable means such as bolts 70, are employed for retaining the beverage conduits 27 in a fixed relationship relative to each other and relative to the lower surface 63 of the insulated receptacle 26. Otherwise, the beverage conduits 27 would Have a tendency to spring apart and the line would be susceptible to freezing in the ice bank 37. All of the beverage conduits 27 pass under baffle plate 28 and enter and exit the insulated receptacle 26 above portal chamber 63.

By making the baffle plate 28 so that its lower portion 80 does not completely extend from one side to the other of the insulated receptacle 26, some of water 36 is circulated around baffle plate 28 by impeller 23. This flow of water around baffle plate 28 along with heat transfer through baffle plate 28 maintains the exiting beverage conduits 27, which are connected to dispenser heads 30, at a very low temperature.

While beverage dispenser 10 is of the post mix type, it is particularly desirable that the syrup be maintained as close to freezing point as possible to reduce the amount of bubbling caused by carbonation. Since the syrup and soda normally mix with one part syrup to five parts soda, a shorter length of beverage conduit 27 is required for each syrup than is required for the soda. Because of the difference in density between syrups and soda and to insure that the syrup is as close to the freezing point as possible without freezing, the length of the soda line should be approximately four times as great as the length of each syrup line contained within cooling chamber 65.

By arranging the beverage conduits 27 and the evaporator coils 20 in the manner described, a much better beverage dispensing machine having a low profile can be manufactured for use in the commercial market. Once the evaporator coils 20 are inserted in the water and allowed to operate for a period of time, an ice bank 37 will accumulate around the evaporator coils 20. The ice bank control 25 will control the operation of the compressor 18 so that the ice bank accumulation will not become too excessive. Impeller 23 continually circulates the water 36 inside the insulated receptacle 26 to insure a uniform heat distribution. Beverage conduits 27 that are configured near the lower surface 63 of the insulated receptacle 26 are cooled to a near freezing point. By locating the evaporator coils 20 above the beverage conduits 27, a large ice bank 37 (in the form of a slab) can accumulate without freezing the beverage in the beverage conduits 27. This large ice bank accumulation greatly increases the maximum capacity of the drink dispensing unit.

The baffle plate 28 can be manufactured from a substance such as aluminum or stainless steel or any other suitable alloy which enables heat transfer therethrough without freezing the beverage conduits 27 as they enter or exit the portal chamber 69. Thus, any drink dispensed after a long period of non-use would be of an acceptable temperature, between freezing and forty degrees Fahrenheit.

The beverage dispenser embodying the present invention has been described as a four drink dispenser post mix type potentially using water, four separate syrups A–D and soda. This type of beverage dispenser is more complicated than the pre-mixed type which only requires one line for each drink that is to be dispensed. Therefore, it should be obvious that the present invention can be used with the pre-mixed type as well as the post mix. Another obvious alternative is to have the concentrated drink, such as orange juice, where the concentrated portion is mixed with water, although this can easily be accomplished by the preferred embodiment as well. It will also be obvious that various other configurations of the beverage conduits 27 or the evaporator coils 20 may be employed to take advantage of various features of the present invention.

Further, although the present invention has been described in terms of the foregoing preferred embodiment, as would be obvious to one of ordinary skill in the art many other reconfigurations, alterations and substitutions are also enabled by this disclosure, and it is therefore intended that the scope of the invention not be limited by the foregoing but rather encompass such and be defined by the following claims.

I claim:

1. An apparatus for employment in a beverage dispenser to refrigerate a liquid comprising:

a receptacle defining a cooling chamber for containing said liquid;

means for conducting said liquid through said cooling chamber; and means for forming a slab of frozen material above said conducting means such that the frozen slab of ice is positioned totally above the means for conducting said liquid.

2. The apparatus of claim 1 further comprising:

means for enabling communication of said liquid with a liquid supply external to said receptacle; and means for circulating a fluid between said slab and said conducting means to enable transfer of heat therebetween.

3. The apparatus of claim 2 wherein:

said communication enabling means comprises a baffle plate connected to said receptacle; and said slab forming means is adapted to form a slab which encapsulates said cooling chamber.

4. The apparatus of claim 3 wherein said slab forming means has features for forming said slab in a manner which enables communication of a shaft of said circulating means through said slab.

5. The apparatus of claim 1 wherein:

said conducting means comprises a beverage conduit; and said slab forming means comprises evaporation coils partially disposed within said cooling chamber for freezing said fluid to form ice around said evaporation coils.

6. The apparatus of claim 5 wherein said beverage conduit is configured in a plane parallel to and across the base of said receptacle.

7. The apparatus of claim 6 further comprising an impeller, operatively connected by a shaft to a motor of said slab forming means, said slab being formed in a manner which accommodates passage and rotation of the shaft of said impeller through said slab.

8. A method for cooling a beverage in a cooling chamber which contains a fluid and has a low profile, said method comprising the steps of:

(a) forming a slab of ice which spans between the perimeters of said cooling chamber at the upper portions thereof; and (b) directing said beverage through beverage conduits contained in the lower portions of said cooling chamber wherein the frozen slab of ice is positioned totally above the means for conducting said liquid.

* * * * *

US004916910C1

(12) EX PARTE REEXAMINATION CERTIFICATE (5871st)

United States Patent
Schroeder

(10) Number: US 4,916,910 C1
(45) Certificate Issued: Aug. 28, 2007

(54) LOW PROFILE DRINK DISPENSER

(75) Inventor: Alfred A. Schroeder, San Antonio, TX (US)

(73) Assignee: Lancer Partnership Ltd., San Antonio, TX (US)

Reexamination Request:
No. 90/006,793, Oct. 15, 2003

Reexamination Certificate for:

| | |
|---|---|
| Patent No.: | **4,916,910** |
| Issued: | **Apr. 17, 1990** |
| Appl. No.: | **07/217,169** |
| Filed: | **Jul. 11, 1988** |

(51) Int. Cl.
*F25D 3/00* (2006.01)

(52) U.S. Cl. ..... 62/59; 62/390; 62/434

(58) Field of Classification Search ..... None
See application file for complete search history.

(56) References Cited

U.S. PATENT DOCUMENTS

| | | | | |
|---|---|---|---|---|
| 1,513,194 | A | 10/1924 | Stein | |
| 3,270,520 | A | 9/1966 | Geisler | |
| 3,892,335 | A | 7/1975 | Schroeder | 222/129.1 |
| 4,272,968 | A | 6/1981 | Harvill | 62/394 |
| 4,592,490 | A | 6/1986 | McMichael | 222/129.1 |
| 4,886,190 | A | 12/1989 | Kirschner et al. | 222/57 |

FOREIGN PATENT DOCUMENTS

| | | |
|---|---|---|
| JP | 42-21645 | 12/1967 |
| JP | 47-26918 | 8/1972 |
| JP | 50-32641 | 4/1975 |
| JP | 55-12065 | 1/1980 |

OTHER PUBLICATIONS

Sentry II drawings and parts list; Author; IMI Cornelius, Inc. Date: Oct. 28, 1981, pp. all as included.

*Primary Examiner*—Aaron J. Lewis

(57) ABSTRACT

A beverage dispenser of the post mix type having evaporator coils configured in a particular manner to form a slab of ice within a cooling chamber, the formation of which slab of ice in controlled by a thermostat so that a vertically oriented passage is formed in the center of the slab to allow the rotation of an impeller shaft. With the cooling chamber and a passage for connecting with dispenser valves being insulated beneath and beside the compressor and other heat generating components of the cooling unit, the impeller is thus able to operate beneath the ice slab to circulate cooled water around beverage conduits that are layered in a compact configuration, the overall arrangement of the beverage dispenser being compact and resulting in a easily serviceable beverage dispenser having a low profile while also providing a relatively large ice bank and enabling optimum heat exchange between the beverage conduits and the slab of ice without causing freezing of the beverages.

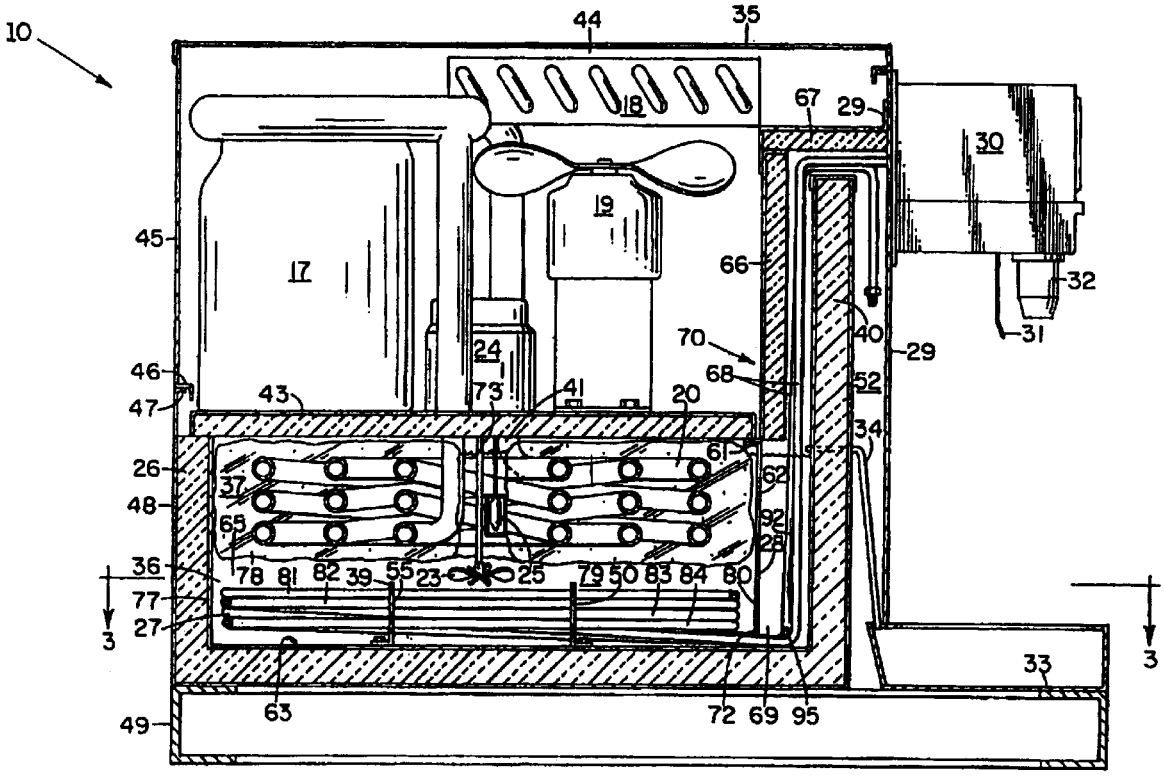

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 8 are determined to be patentable as amended.

Claims 2–7, dependent on an amended claim, are determined to be patentable.

New claims 9–31 are added and determined to be patentable.

1. An apparatus for employment in a beverage dispenser to refrigerate a liquid comprising:

a receptacle defining a cooling chamber for containing said liquid;

means for conducting said liquid through said cooling chamber; and means for forming a *frozen* slab of [frozen material] *ice* above said conducting means such that the frozen slab of ice is positioned totally above the means for conducting said liquid*;*

*wherein said receptacle comprises sidewalls and wherein said slab forming means operates to create said slab such that said slab contacts at least a plurality of said sidewalls.*

8. A method for cooling a beverage in a cooling chamber which contains a fluid and has a low profile, said method comprising the steps of:

(a) forming a slab of ice which spans between the perimeters of said cooling chamber at the upper portions thereof; and (b) directing said beverage through beverage conduits contained in the lower portions of said cooling chamber wherein the frozen slab of ice is positioned totally above the [means for conducting said liquid] *beverage conduits;*

*wherein said cooling chamber comprises four sidewalls, and wherein forming a slab of ice comprises forming said slab such that said slab contacts at least a plurality of said sidewalls.*

*9. The apparatus of claim 1, wherein said liquid comprises plain water, and wherein said conducting means comprises a compactly configured beverage conduit in the bottom of said cooling chamber.*

*10. The apparatus of claim 9, and further comprising an impeller for circulating a fluid between and into contact with said slab and said conducting means to enable transfer of heat therebetween.*

*11. The apparatus of claim 5, wherein said beverage conduit is configured in a plurality of compact layers in the bottom of said cooling chamber.*

*12. The apparatus of claim 1, and further comprising a housing surrounding said receptacle, said means for conducting, and said means for forming a slab, and further comprising at least one beverage dispensing nozzle coupled to said housing.*

*13. The apparatus of claim 12, wherein said conducting means comprises a beverage conduit, and said beverage conduit is configured in one or more compact layers in the bottom of said cooling chamber.*

*14. The apparatus of claim 12, wherein said conducting means comprises a beverage conduit, and said beverage conduit is configured in a plurality of compact layers in the bottom of said cooling chamber.*

*15. The apparatus of claim 14 and further comprising an impeller for circulating a fluid between and into contact with said slab and said beverage conduit, to enable transfer of heat therebetween.*

*16. The apparatus of claim 12, wherein said housing comprises a cover and a casing.*

*17. The apparatus of claim 16, wherein said conducting means comprises a beverage conduit, and said beverage conduit is configured in one or more compact layers in the bottom of said cooling chamber.*

*18. The apparatus of claim 16, wherein said conducting means comprises a beverage conduit, and said beverage conduit is configured in a plurality of compact layers in the bottom of said cooling chamber.*

*19. The apparatus of claim 18, and further comprising an impeller for circulating a fluid between and into contact with said slab and said beverage conduit, to enable transfer of heat therebetween.*

*20. The apparatus of claim 1, wherein said conducting means comprises a beverage conduit, and said beverage conduit is configured in a plurality of compact layers in the bottom of said cooling chamber.*

*21. A beverage dispenser, comprising:*

*a receptacle defining a cooling chamber for cooling a liquid, said receptacle comprising sidewalls;*

*means for conducting said liquid through said cooling chamber, wherein said liquid comprises plain water, and wherein said conducting means comprises a compactly configured beverage conduit in the bottom of said cooling chamber;*

*means for forming a slab of frozen material above said conducting means such that the frozen slab is positioned totally above the means for conducting said liquid, wherein said slab forming means operates to create said slab such that said slab contacts at least a plurality of said sidewalls;*

*a housing surrounding said receptacle, said means for conducting, and said means for forming a slab; and*

*at least one beverage dispensing nozzle coupled to said housing.*

*22. The apparatus of claim 21, and further comprising means for circulating a fluid between said slab and said conducting means to enable transfer of heat therebetween, and wherein said slab forming means operates to create said slab to enable operation of said circulating means through said slab.*

*23. The apparatus of claim 21, wherein said beverage conduit is configured in one or more compact layers in the bottom of said cooling chamber.*

*24. The apparatus of claim 21, wherein said beverage conduit is configured in a plurality of compact layers in the bottom of said cooling chamber.*

*25. The apparatus of claim 24, and further comprising an impeller for circulating a fluid between and into contact with said slab and said conducting means, to enable transfer of heat therebetween.*

*26. The apparatus of claim 21, wherein said housing comprises a cover and a casing.*

*27. The apparatus of claim 26, wherein said beverage conduit is configured in one or more compact layers in the bottom of said cooling chamber.*

*28. The apparatus of claim 26, wherein said beverage conduit is configured in a plurality of compact layers in the bottom of said cooling chamber.*

*29. The apparatus of claim 28, and further comprising an impeller for circulating a fluid between and into contact with said slab and said conducting means, to enable transfer of heat therebetween.*

*30. A method for cooling and dispensing a liquid in a beverage dispenser which has a low profile and a cooling chamber which contains a fluid, said cooling chamber comprising four sidewalls, said method comprising:*

(*a*) *forming a slab of ice at the upper portions of said cooling chamber such that said slab contacts at least a plurality of said sidewalls;*

(*b*) *directing said liquid through a beverage conduit contained in the lower portions of said cooling chamber wherein the frozen slab of ice is positioned totally above said beverage conduit; and*

(*c*) *dispensing said liquid through a dispensing nozzle coupled to a housing that surrounds said slab of ice and said beverage conduit.*

*31. The method of claim 30, and further comprising mixing said liquid with another liquid to form a mixed beverage that is dispensed from said beverage dispenser.*

* * * * *